US009382597B2

(12) United States Patent
Cho et al.

(10) Patent No.: US 9,382,597 B2
(45) Date of Patent: Jul. 5, 2016

(54) STEEL SHEET FOR ENAMEL HAVING NO SURFACE DEFECTS AND METHOD OF MANUFACTURING THE SAME

(75) Inventors: Hang-Sik Cho, Pohang-shi (KR); Woo-Yeol Cha, Pohang-shi (KR); Su-Beom Park, Pohang-shi (KR); Woo-Sung Kim, Pohang-shi (KR)

(73) Assignee: POSCO, Pohang-si (KR)

( * ) Notice: Subject to any disclaimer, the term of this patent is extended or adjusted under 35 U.S.C. 154(b) by 527 days.

(21) Appl. No.: 13/824,606

(22) PCT Filed: Dec. 19, 2011

(86) PCT No.: PCT/KR2011/009799

§ 371 (c)(1), (2), (4) Date: Mar. 18, 2013

(87) PCT Pub. No.: WO2012/091340

PCT Pub. Date: Jul. 5, 2012

(65) Prior Publication Data

US 2013/0180632 A1 Jul. 18, 2013

(30) Foreign Application Priority Data

Dec. 27, 2010 (KR) ..... 10-2010-0135876

(51) Int. Cl.

| | |
|---|---|
| ***C22C 38/02*** | (2006.01) |
| ***C21D 8/02*** | (2006.01) |
| ***C21D 9/46*** | (2006.01) |
| ***C22C 38/00*** | (2006.01) |

(Continued)

(52) U.S. Cl.

CPC ..... *C21D 8/0263* (2013.01); *B21B 15/00* (2013.01); *C21D 8/02* (2013.01); *C21D 8/0205* (2013.01); *C21D 9/46* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/20* (2013.01)

(58) Field of Classification Search

CPC ..... C21D 8/02; C22C 38/20; C22C 38/06; C22C 38/04; C22C 38/02; C22C 38/00; B21B 15/00

See application file for complete search history.

(56) References Cited

U.S. PATENT DOCUMENTS

| | | | | |
|---|---|---|---|---|
| 3,944,442 | A * | 3/1976 | Donachie | C22C 38/18 148/506 |
| 2003/0116232 | A1 * | 6/2003 | Marchionni | C21D 8/0215 148/320 |

(Continued)

FOREIGN PATENT DOCUMENTS

| | | | |
|---|---|---|---|
| CN | 101356295 | A | 1/2009 |
| CN | 101535517 | A | 9/2009 |

(Continued)

*Primary Examiner* — Veronica F Faison

(74) *Attorney, Agent, or Firm* — The Webb Law Firm

(57) ABSTRACT

A steel sheet for enameling for eliminating surface defects such as fish scale defects and having excellent formability, and provides a steel sheet for enamel having no surface defects, including: more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities.

13 Claims, 1 Drawing Sheet

(51) Int. Cl.

| | |
|---|---|
| ***C22C 38/04*** | (2006.01) |
| ***C22C 38/06*** | (2006.01) |
| ***C22C 38/20*** | (2006.01) |
| ***B21B 15/00*** | (2006.01) |

(56) References Cited

U.S. PATENT DOCUMENTS

| | | | | |
|---|---|---|---|---|
| 2003/0129444 | A1* | 7/2003 | Matsuoka | C22C 38/001 428/659 |
| 2009/0047168 | A1 | 2/2009 | Murakami et al. | |
| 2010/0086431 | A1 | 4/2010 | Murakami et al. | |
| 2010/0277405 | A1* | 11/2010 | Park | C22C 1/002 345/92 |

FOREIGN PATENT DOCUMENTS

| | | | |
|---|---|---|---|
| JP | 08013089 | A | 1/1996 |
| JP | 2000001741 | A | 1/2000 |
| JP | 2000063985 | A | 2/2000 |
| JP | 2000-144313 | | 5/2000 |
| JP | 2001-031760 | | 11/2001 |
| JP | 2002249850 | A | 9/2002 |
| JP | 2003096542 | A | 4/2003 |
| KR | 1020080058477 | A | 6/2008 |
| KR | 1020090049609 | A | 5/2009 |
| KR | 1020110070408 | A | 6/2011 |
| WO | 2007055400 | A1 | 5/2007 |
| WO | 2008038474 | A1 | 4/2008 |

* cited by examiner

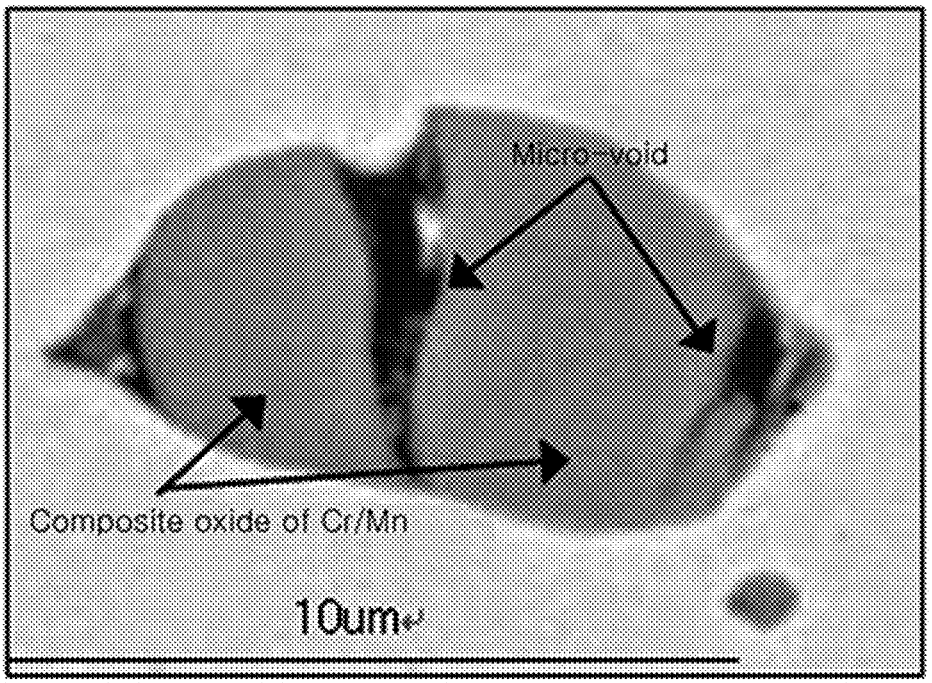
Micro-void
Composite oxide of Cr/Mn
10um

STEEL SHEET FOR ENAMEL HAVING NO SURFACE DEFECTS AND METHOD OF MANUFACTURING THE SAME

TECHNICAL FIELD

The present invention relates to a steel sheet for enamel. More particularly, the present invention relates to a steel sheet for enamel not generating surface defects such as fish scale defects and having excellent formability, and a method of manufacturing the same.

BACKGROUND ART

A steel sheet for enamel is used in home appliances, chemical equipment, cooking tools, sanitary appliances, interior and exterior materials for building, and the like.

There is a hot rolled steel sheet or a cold rolled steel sheet as the steel sheet for enamel, but the cold rolled steel sheet is mainly used for the purpose of high function and processing. Examples of the steel sheet for enamel include rimmed steel, OCA steel (open coil aluminum steel), titanium-added steel, high oxygen steel, and the like. Examples of important defects in the steel sheet for enamel include fish scales.

The fish scales mean defects formed when hydrogen gas collected in the steel is discharged between a surface of the steel and an enamel layer to lift a surface of the enamel layer in a form of scales of fish. The fish scales are formed when hydrogen solid-soluted in the steel during a process of manufacturing the steel sheet for enamel is discharged to the surface of the steel in a cooling state but not discharged to the outside because the enamel layer on the surface of the steel is previously hardened.

As described above, since the fish scale defect is caused by hydrogen, it is necessary to form a position where hydrogen can be adsorbed in the steel in order to prevent the defects from being formed.

The adsorption position of hydrogen may be micro-voids, inclusions, deposits, a dislocation, a grain boundary, or the like.

In the case of the rimmed steel, since an oxygen content is high, the inclusion may be generated in a large amount to prevent fish scale defects from being formed. However, since the rimmed steel can be manufactured by only a steel ingot casting method, productivity is not high. Accordingly, an enamel molten steel that can be manufactured by continuous casting having high productivity is required.

A Ti or Nb-added enamel molten steel is manufactured by using a continuous annealing process in order to reduce manufacturing cost. However, since the enamel molten steel has a high re-crystallization temperature, annealing treatment should be performed at high temperatures, and thus there are drawbacks in that productivity is low and manufacturing cost is high.

Further, in the case where the Ti-added steel is continuously cast by added Ti, a nozzle is clogged, and in the case where a large amount of inclusion is exposed to the surface of the steel sheet, bubble defects are generated after an enamel treatment. Further, in the case of the Ti-added steel, added Ti generates inclusions such as TiN, and there is a problem in that the TiN inclusion exists on the surface of the steel sheet to reduce a close contacting property of the enamel.

In addition, the high oxygen steel having the increased oxygen content can ensure a hydrogen occlusion ability by using oxides in the steel.

However, since the high oxygen steel has the high oxygen content in the steel, a fireproof material is melted during continuous casting, and thus productivity by continuous casting is very low.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a steel sheet for enamel, which can be subjected to continuous casting and has high productivity, no surface defects such as fish scales and bubble defects, and excellent formability.

Further, the present invention has been made in an effort to provide a method of manufacturing a steel sheet for enamel, which enables continuous casting and has high productivity, no surface defects such as fish scales and bubble defects, and excellent formability.

An exemplary embodiment of the present invention provides a steel sheet for enamel having no surface defects, including: more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities.

In the steel sheet for enamel according to an exemplary embodiment of the present invention, a Cr—Mn complex oxide is formed in the steel sheet for enamel, and an atomic ratio of Cr/Mn in the Cr—Mn complex oxide is in the range of 0.01 to 2.

Further, in the steel sheet for enamel according to the exemplary embodiment of the present invention, a size of the Cr—Mn complex oxide is 1 to 25 μm, and the number of the Cr—Mn complex oxides is $1.5\times10^2$ or more per 1 $mm^2$ of an observation view.

Another exemplary embodiment of the present invention provides a method of manufacturing a steel sheet for enamel having no surface defects, including: manufacturing a slab formed of more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities; manufacturing a hot rolled steel sheet by hot rolling after the slab is re-heated to 1,200° C. or more; and winding the hot rolled steel sheet at 550° C. or more.

The method of manufacturing a steel sheet for enamel according to the exemplary embodiment of the present invention further includes: performing cold rolling at a reduction ratio of 50 to 90% after the winding.

Further, the method of manufacturing a steel sheet for enamel according to the exemplary embodiment of the present invention further includes: performing continuous annealing of the cold rolled steel sheet at 700° C. or more for 20 sec or more after the cold rolling.

In the steel sheet for enamel manufactured according to the exemplary embodiment of the present invention, a Cr—Mn complex oxide may be formed and an atomic ratio of Cr/Mn in the Cr—Mn complex oxide may be controlled to 0.01 to 2.

In addition, in the steel sheet for enamel manufactured according to the exemplary embodiment of the present invention, a size of the Cr—Mn complex oxide may be 1 to 25 μm and the number of the Cr—Mn complex oxides may be $1.5\times10^2$ or more per 1 $mm^2$ of an observation view.

The steel sheet for enamel according to the exemplary embodiment of the present invention can efficiently prevent a fish scale defect that is one of major defects of the steel sheet for enamel. Generally, the fish scale defect means a matter generated when hydrogen solid-soluted in the steel is discharged to the surface of the steel in a cooling state during a process of manufacturing the steel sheet for enamel.

Accordingly, a large amount of sites at which hydrogen solid-soluted in the steel can be adsorbed needs to be formed in the steel in order to prevent the fish scale defect. Generally, in a kind of enamel steel using a known deposit, TiS, TiN, BN, cementite, and the like are used as the hydrogen occlusion site.

In the steel sheet for enamel according to the exemplary embodiment of the present invention, the Cr—Mn complex oxide is uniformly dispersed during solidification to be broken during hot rolling and cold rolling to form micro-voids, thus occluding hydrogen, and thereby the fish scale can be prevented.

Further, as compared to a precipitation system precipitated after solidification, there is a merit in that since stable oxides are used as the hydrogen occlusion sites at high temperatures, the generated oxides are hardly affected according to a hot rolling and cold rolling control condition to improve an operation property.

The total amount of the Cr—Mn complex oxide is proportional to the total oxygen amount in the steel, and generation of the fish scale can be suppressed under a condition of the total oxygen amount of 300 ppm or more.

Since Mn and Cr used in the exemplary embodiment of the present invention can maintain high dissolved oxygen before solidification during continuous casting, it is possible to ensure the total oxygen amount. Further, in the exemplary embodiment of the present invention, since a large amount of dissolved oxygen existing before solidification is totally bonded to Cr and Mn during solidification, defects such as pin-holes are not generated.

Further, since Ti is not added, an enamel close contacting property does not deteriorate, and surface defects are not caused by Ti. In the steel sheet for enamel of the present invention, a interrelationship between atomic ratios of Cr/Mn in the Cr—Mn complex oxide can be appropriately controlled to prevent the surface defects.

In addition, since the steel sheet for enamel according to the exemplary embodiment of the present invention can be manufactured by continuous casting and produced by continuous annealing, it is possible to provide a cold rolled steel sheet having a low manufacturing cost, high productivity, no surface defects, and an excellent enamel property.

A steel sheet for enamel according to an exemplary embodiment of the present invention provides a technology of preventing bubble defects and fish scales from being generated by suppressing a chemical component composition of a steel within an appropriate range and actively using dissolved oxygen in a steel sheet to uniformly form oxides in a large amount during solidification in the steel sheet, so that the oxides act as a hydrogen adsorption source.

The steel sheet for enamel according to the exemplary embodiment of the present invention provides a technology of utilizing a Cr—Mn complex oxide as a hydrogen occlusion site by forming the Cr—Mn complex oxide stable at high temperatures and appropriately controlling an atomic ratio value of Cr/Mn in the complex oxide.

The steel sheet for enamel according to the exemplary embodiment of the present invention can more efficiently generate micro-voids by controlling the atomic ratio of Cr/Mn to 0.01 to 2, which is low, to further increase non-uniformity in the oxide. Accordingly, there is a technical effect of significantly reducing a content of costly Cr.

Further, in the steel sheet for enamel according to the exemplary embodiment of the present invention, since formed sulfides are stretched well due to high sulfur (S), oxides are broken after rolling to hinder the micro-voids from being formed, and thus it is preferable to reduce the content of sulfur (S) to the utmost. Manganese (Mn) and copper (Cu) are representative elements for forming sulfides, and manganese (Mn) cannot be reduced because manganese (Mn) is essential to form MnO usefully used in the present invention, but copper (Cu) has weak bonding force to oxygen, which do not easily form oxides and is bonded to sulfur (S) to be attached to complex oxides to form sulfides, thus breaking oxides during rolling to suppress generation of the formed micro-voids, accordingly, it is preferable to reduce copper to the utmost.

Accordingly, the steel sheet for enamel according to the exemplary embodiment of the present invention exhibits a technical effect of providing an enamel steel sheet having no bubble defects and preventing generation of fish scales by controlling the content of copper (Cu) performing the aforementioned role.

BRIEF DESCRIPTION OF THE DRAWING

The drawing is a photomicrograph obtained by observing Cr—Mn complex oxide formed in a steel sheet for enamel according to an exemplary embodiment of the present invention by using a field emission scanning electron microscope (FE-SEM) and an energy dispersive X-ray spectrometer (EDS).

DETAILED DESCRIPTION OF THE INVENTION

The terminologies used herein are set forth to illustrate a specific exemplary embodiment but not to limit the present invention. It must be noted that, as used in the specification and the appended claims, the singular forms include plural references unless the context clearly dictates otherwise. It will be further understood that the terms "comprises" and/or "comprising," when used in this specification, specify the presence of stated properties, regions, integers, steps, operations, elements, and/or components, but do not preclude the presence or addition of one or more other properties, regions, integers, steps, operations, elements, components, and/or groups.

Unless it is not mentioned, all terms including technical terms and scientific terms used herein have the same meaning as the meaning generally understood by the person with ordinary skill in the art to which the present invention belongs. The terminologies that are defined previously are further understood to have the meaning that coincides with the contents that are disclosed in relating technical documents, but not as the ideal or very official meaning unless it is not defined.

Further, in the present invention, all expressions of chemical compositions of the component element mean wt % unless otherwise specified.

Hereinafter, exemplary embodiments of a steel sheet for enamel and a method of manufacturing the same according to the present invention will be described in detail, but the present invention is not limited to the following exemplary embodiments. Accordingly, it is to be understood that modifications will be apparent to those skilled in the art without departing from the spirit of the invention.

In the present invention, all contents of the component element mean wt % unless otherwise specified.

Hereinafter, a steel sheet for enamel according to an exemplary embodiment of the present invention will be described in detail.

The steel sheet for enamel according to the exemplary embodiment of the present invention includes more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities.

Hereinafter, the reason of limiting a component element in the steel sheet for enamel according to the exemplary embodiment of the present invention will be described.

Carbon (C) is added in the amount of more than 0% and 0.005% or less. In the case where carbon (C) is added in the amount of 0.005% or more, since the amount of carbon solid-soluted in the steel is large, development of a crystal texture during annealing is disturbed, and thus formability is reduced and an aging phenomenon occurs.

Accordingly, in the case where processing is performed a long period of time after a carbon steel is produced, there is a high possibility of generating surface defects (stretcher strain defect), and thus it is preferable that an upper limit value of carbon (C) be limited to 0.005%.

Manganese (Mn) is bonded to dissolved oxygen in a molten steel to form Mn oxides. Further, sulfur solid-soluted in the steel is precipitated in manganese sulfides to be added in order to prevent hot shortness. Accordingly, a lower limit value of the content of manganese is set to 0.1% because a possibility of occurrence of hot shortness is high at the content of 0.1% or less, and an upper limit value thereof is set to 0.5% because formability is largely reduced to generate defects during forming when the content of manganese is 0.5% or more.

Since silicon (Si) is used as a deoxidizing agent removing oxygen in the molten steel, it is preferable to limit the upper limit value of Si to 0.03%.

Phosphorus (P) is an element hindering physical properties of the steel, and since formability is largely reduced at the content of 0.03% or more, it is preferable to set the upper limit value thereof to 0.03%.

Sulfur (S) is generally known as an element hindering physical properties of the steel, and since ductility is largely reduced and hot shortness easily occurs due to sulfur at the content of 0.02% or more, it is preferable to limit the upper limit value to 0.02%. Further, since sulfides formed by sulfur (S) are formed while being attached to the complex oxide, oxides are broken after rolling to hinder the micro-voids from being formed or fill the formed micro-voids, and thus it is preferable to reduce the content of sulfur (S) to the utmost.

Aluminum (Al) generally has a strong oxidizing property to act as the deoxidizing agent and suppress generation of oxides other than alumina oxides. However, in the case where aluminum forms oxides, since aluminum oxides remain in the steel or on the surface of the steel to increase a possibility of generating the surface defects, it is preferable to limit the upper limit value of aluminum to 0.03%.

Since copper (Cu) may hinder a reaction between the enamel layer and the steel sheet and reduce processability when being added in an excessive amount, it is preferable to set the upper limit value to 0.015%. Further, since copper (Cu) is bonded to sulfur (S) to be attached to the complex oxide to form sulfides, which breaks oxides during rolling to hinder the micro-voids from being generated, it is preferable to reduce the content of copper (Cu) to the utmost.

In the case where the content of nitrogen (N) is excessively high, since the amount of solid-soluted nitrogen is increased to reduce formability and increase a possibility of generating the bubble defects, it is preferable to control the upper limit value thereof to 0.005%.

Chrome (Cr) is an oxide forming element for acting as the hydrogen occlusion site in the exemplary embodiment of the present invention, and is bonded to dissolved oxygen in the molten steel to form Cr oxides, or reduces Mn oxides to form Cr—Mn complex oxides. Accordingly, it is preferable to control a component range of Cr to 0.05% to 0.3% in order to form and control the Cr—Mn complex oxide.

Oxygen (O) acts as an element for effectively preventing fish scales to actively suppress the surface defects. However, in the case where the oxygen content is set to 0.03% or less, since the inclusion effect is reduced, it is preferable to set the content to 0.03% or more. Further, the total amount of oxides may be increased as the content of oxygen is increased, which is preferable, but in the case where oxygen is contained in an excessive amount of 0.1% or more, since a possibility of causing a problem of melting a fireproof material or the like is increased due to a manufacturing process, it is preferable to limit the upper limit value thereof to 0.1%.

The steel sheet for enamel, which has the aforementioned composition, according to the exemplary embodiment of the present invention forms the Cr—Mn complex oxide by an interaction between the contained elements.

In the Cr—Mn complex oxide, in the case where local composition non-uniformity occurs in the complex oxide, a hardness value varies for each position of the steel sheet, and thus the Cr—Mn oxide itself may be broken and a large amount of the micro-voids may be formed during cold rolling. Accordingly, it is necessary to control an interrelationship between the contents of Mn and Cr in the complex oxide used as the hydrogen occlusion site.

That is, in the case of the steel sheet for enamel according to the exemplary embodiment of the present invention, it is necessary to control an interrelationship between the atomic ratio value of Cr/Mn and the hydrogen occlusion ability in the Cr—Mn complex oxide.

To this end, it is preferable to limit the atomic ratio of Cr/Mn in the Cr—Mn complex oxide to 0.01 to 2. If the atomic ratio of Cr/Mn in the Cr—Mn complex oxide is controlled to be less than 0.01, since a possibility of generating the surface defects is very high, it is preferable to set the lower limit value thereof to 0.01. Further, in the case where the atomic ratio value of Cr/Mn in the Mn complex oxide is more than 2, since the amount of generated fish scales is rapidly increased, it is preferable to control the upper limit value thereof to be 2 or less.

In the steel sheet for enamel manufactured according to the exemplary embodiment of the present invention, a representative example where the Cr—Mn complex oxide is broken by cold rolling to generate the micro-voids is illustrated in FIG. 1.

As illustrated in FIG. 1, observation is performed by using a field emission scanning electron microscope (FE-SEM) and an energy dispersive X-ray spectrometer (EDS), and as a result, it can be seen that the micro-voids are formed in a broken portion of the Cr—Mn complex oxide.

In addition, in the steel sheet for enamel according to the exemplary embodiment of the present invention, it is preferable to limit the size and the number of the Cr—Mn complex oxides as means for ensuring fish scale resistance.

This is because the position at which hydrogen can be occluded in the steel sheet for enamel is the portion where the complex oxide itself is broken or the micro-voids generated during cold rolling at an interface of oxide/base steel sheet.

To this end, in the exemplary embodiment of the present invention, it is preferable to limit the size of the Cr—Mn complex oxide to 1 to 25 μm. In the case where the size of the Cr—Mn complex oxide is less than 1 ∞m, a breaking amount during cold rolling is small, and thus the size of the generated micro-void becomes too small. Accordingly, since a hydrogen occlusion effect using the complex oxide is small, it is preferable to limit the size of the Cr—Mn complex oxide to 1 μm or more. Further, in the case where the size of the Cr—Mn complex oxide is more than 25 μm, since the number of oxides is reduced, and thus fish scale resistance cannot be ensured, accordingly, it is preferable to limit the size to 25 μm or less.

Further, in the steel sheet for enamel according to the exemplary embodiment of the present invention, it is preferable to limit the number of Cr—Mn complex oxide to $1.5\times10^2$ or more per 1 $mm^2$ of an observation view. In the case where the number of Cr—Mn complex oxides is less than $1.5\times10^2$ per 1 $mm^2$, since it is difficult to ensure fish scale resistance, it is preferable to limit the number of Cr—Mn complex oxides to the aforementioned value or more.

Hereinafter, a method of manufacturing a steel sheet for enamel according to the exemplary embodiment of the present invention will be described.

First, a slab including more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities is manufactured.

The slab manufactured as described above is re-heated to 1,200° C. or more. In addition, the re-heated slab is subjected to rough rolling, and then finish rolling at a temperature of Ar3 or more.

The hot rolled steel sheet that is subjected to finish rolling is wound at 550° C. or more. The wound hot rolled steel sheet is subjected to pickling treatment to remove an oxide film on the surface of the steel sheet and then subjected to cold rolling. A reduction ratio is set to 50 to 90% during cold rolling. The cold rolled steel sheet is continuously annealed under a condition of 700° C. or more for 20 sec or more.

In the method of manufacturing the steel sheet for enamel according to the exemplary embodiment of the present invention, the reason for limiting the winding temperature of the hot rolled steel sheet after hot rolling to 550° C. or more is as follows. In the case where the hot rolled steel sheet is wound at 550° C. or less after hot rolling, since grains become small by hot rolling, formability is low in a subsequent processing step to make forming difficult, and thus the lower limit value thereof is set to 550° C.

In addition, in the method of manufacturing the steel sheet for enamel according to the exemplary embodiment of the present invention, the reason for limiting the reduction ratio to 50 to 90% during cold rolling is as follows. In the case where the cold reduction ratio is controlled to be excessively low during cold rolling, development of a crystal texture of re-crystallization is low to reduce formability. Further, in the case where the cold reduction ratio is set to be low during cold rolling, since a breaking ability of the Cr—Mn complex oxide is reduced, the lower limit value of the cold reduction ratio is limited to 50%. Further, in the case where the cold reduction ratio is excessively high during cold rolling, since ductility is reduced and an absolute amount of the micro-voids is reduced, the upper limit value thereof is limited to 90%.

Further, in the method of manufacturing the steel sheet for enamel according to the exemplary embodiment of the present invention, the reason for limiting the continuous annealing condition after cold rolling to 700° C. or more and 20 sec or more is as follows. Since continuous annealing after cold rolling is to provide ductility and formability to the cold rolled steel sheet, in the case where continuous annealing is performed at 700° C. or less, re-crystallization of the cold rolled steel sheet is not finished, and thus it is difficult to ensure ductility and formability. Accordingly, the annealing temperature of continuous annealing is limited to 700° C. or more. In addition, in the case where a continuous annealing time is excessively short, since re-crystallization is not finished, ductility and formability of the steel sheet cannot be ensured, and thus the lower limit value thereof is set to 20 sec.

Hereinafter, Examples of the present invention will be described in detail.

Example

Table

The slab having the composition as described in Table 1 was manufactured by melting in the converter, secondary refining, and the continuous casting process.

TABLE 1

| Classification | C | Mn | P | S | Si | Al | N | Cr | Cu | O |
|---|---|---|---|---|---|---|---|---|---|---|
| Invention steel 1 | 0.0012 | 0.26 | 0.015 | 0.0061 | 0.003 | 0.0011 | 0.0019 | 0.27 | 0.002 | 0.043 |
| Invention steel 2 | 0.0015 | 0.22 | 0.014 | 0.0064 | 0.004 | 0.0023 | 0.0021 | 0.16 | 0.009 | 0.051 |
| Invention steel 3 | 0.0013 | 0.35 | 0.016 | 0.0095 | 0.002 | 0.0042 | 0.0025 | 0.23 | 0.011 | 0.046 |
| Invention steel 4 | 0.0016 | 0.43 | 0.013 | 0.0045 | 0.012 | 0.0041 | 0.0032 | 0.11 | 0.008 | 0.035 |
| Invention steel 5 | 0.0017 | 0.28 | 0.011 | 0.0105 | 0.008 | 0.0052 | 0.0027 | 0.09 | 0.005 | 0.067 |
| Comparative steel 1 | 0.0015 | 0.29 | 0.012 | 0.0048 | 0.009 | 0.0048 | 0.0016 | 0.06 | 0.014 | 0.013 |
| Comparative steel 2 | 0.0019 | 0.03 | 0.013 | 0.0055 | 0.005 | 0.0065 | 0.0028 | 0.16 | 0.02 | 0.026 |
| Comparative steel 3 | 0.0014 | 0.32 | 0.015 | 0.0071 | 0.012 | 0.0320 | 0.0068 | 0.42 | 0.013 | 0.003 |
| Comparative steel 4 | 0.0015 | 0.31 | 0.011 | 0.035 | 0.013 | 0.0021 | 0.0031 | 0.21 | 0.22 | 0.031 |

The content of the component element in Table 1 was represented by wt %, the remaining portion was Fe, and other inevitable impurities were included.

The slab having the composition as described in Table 1 was maintained in the heating furnace at 1,250° C. for 1 hour, and then subjected to hot rolling. In this case, the rolling temperature of finish hot rolling was set to 900° C., and the winding temperature was set to 650° C.

The final plate thickness of the steel sheet after hot rolling was 3.2 mm. The hot rolled steel sheet manufactured as described above was subjected to pickling treatment to remove the oxide film of the surface, and then subjected to cold rolling.

In this case, the cold reduction ratio was set to 75%, and the thickness of the steel sheet after cold rolling was 0.8 mm.

The enamel-treated specimen for examining the characteristics of the enamel was processed by using the cold rolled steel sheet. Continuous annealing was performed over the enamel-treated specimen, and the enamel-treated specimen was cut in the size of 70 mm×150 mm.

portion of each specimen by using the field emission scanning electron microscope (FE-SEM). In addition, the composition of the complex oxide was examined by the energy dispersive X-ray spectrometer (EDS).

Further, the size of the complex oxide and the number of complex oxides per 1 $mm^2$ were calculated by finding the number of complex oxides having the average size of 1 to 25 μm by using the electron microscope in the magnitude of 5000 times by the image of 40 views according to the point counting method, and performing converting based on 1 $mm^2$ by using the image analyzer.

In Table 2, the atomic ratio in the Cr—Mn complex oxide, the number of complex oxides per 1 $mm^2$, the characteristic of the enamel for each condition of the enamel treatment, and the like, which were obtained through the aforementioned process, are each described.

TABLE 2

| Classification | Average atomic ratio of Cr/Mn in oxide | Bubble defect | Number of generated fish scales | Close contacting index of the enamel | Average size of oxide (μm) | Number of Cr—Mn complex oxides (number/$mm^2$) | Composition requirements of the present invention |
|---|---|---|---|---|---|---|---|
| Invention steel 1 | 1.92 | 1 | 0 | Excellent | 1.8 | $6.1 \times 10^2$ | ○ |
| Invention steel 2 | 1.19 | 1 | 0 | Excellent | 3.1 | $8.5 \times 10^2$ | ○ |
| Invention steel 3 | 1.67 | 1 | 0 | Excellent | 2.7 | $7.3 \times 10^2$ | ○ |
| Invention steel 4 | 1.31 | 1 | 0 | Excellent | 2.5 | $4.4 \times 10^2$ | ○ |
| Invention steel 5 | 0.68 | 1 | 0 | Excellent | 1.9 | $5.1 \times 10^2$ | ○ |
| Comparative steel 1 | 0.23 | 1 | 19 | Excellent | 0.6 | $0.9 \times 10^2$ | x |
| Comparative steel 2 | 6.12 | 1 | 50 or more | Excellent | 1.9 | $3.2 \times 10^2$ | x |
| Comparative steel 3 | 1.76 | 2 | 50 or more | Normal | 0.2 | $0.3 \times 10^2$ | x |
| Comparative steel 4 | 1.23 | 1 | 5 | Normal | 2.4 | $4.5 \times 10^2$ | x |

Continuous annealing was performed at the annealing temperature of 830° C. The annealed specimen for enamel treatment, which was subjected to annealing, was completely fat-removed, and the ground coat was applied and dried at 200° C. for 10 mins to completely remove moisture.

The dried specimen was maintained at 830° C. for 7 mins, subjected to firing treatment, and then cooled to room temperature.

The cover coat was applied on the ground enamel-treated specimen, and dried at 200° C. for 10 mins to completely remove moisture.

The dried specimen was subjected to enamel treatment in which the specimen was maintained at 800° C. for 7 mins, subjected to firing treatment and then air-cooled. In this case, the atmosphere condition of the firing furnace was the dew point temperature of 30° C., and was set as the severe condition where the fish scale defects were most easily generated.

The enamel-treated specimen was maintained in the maintaining furnace at 200° C. for 20 hours, and subjected to fish scale acceleration treatment, and the number of generated fish scale defects was examined by the naked eye.

The close contacting property of the enamel was evaluated by using the close contacting test meter (test meter according to the ASTM C313-78 regulation).

In the following Table 2, the close contacting property of the enamel for each of the invention steels and the comparative steels is described.

Herein, the bubble defects were judged by the naked eye, and were judged by 1 to 3 steps of 1: excellent, 2: normal, and 3: poor.

In addition, the atomic ratio value of Cr/Mn and the size of the micro-voids in the Cr—Mn complex oxide of the present invention steel and the comparative steel described in the following Table 2 were obtained by observing the central As described in Table 2, in invention steels 1 to 5 belonging to the range of the present invention, since the number and the size of the complex oxides belonged to the range limited in the present invention, fish scales were not generated under the severe condition, fish scale resistance was ensured, and the close contacting index of the enamel was excellent, which exhibited the high close contacting property.

However, in comparative steel 1, since the content of Cr was low, the atomic ratio value in the Cr—Mn complex oxide was 0.23, which corresponded to the range of 0.01 to 2 that were values proposed by the present invention steels, but since the content of oxygen was lower than the reference value, the average size of the Cr—Mn complex oxide was 0.6 urn, which was small, and the total number of oxides was reduced, and thus the hydrogen occlusion ability was reduced to generate 19 fish scales in the material.

Further, in comparative steel 2, the average size and the number of the Cr—Mn complex oxides were included in the range proposed by the present invention, but since the content of Mn was low, the average atomic ratio in the Cr—Mn complex oxide was 6.12, which was higher than 0.01 to 3 that were the values proposed by the present invention steels, and thus the hydrogen occlusion ability of the Cr—Mn complex oxide was reduced to generate 50 or more fish scales in the material.

Accordingly, there was obtained the result that if the atomic contents of Cr and Mn in the Cr—Mn complex oxide did not belong to the invention range of the present invention, even though the number of Cr—Mn complex oxides was satisfied, the hydrogen occlusion ability was not increased.

In addition, in the case of comparative steel 3, the average atomic ratio of Cr/Mn in the oxide and the contents of Mn and Cr belonged to the range of the present invention, but the content of Al was high and the content of O was very low.

Accordingly, the average size of the Cr—Mn complex oxides was 0.2 μm, which was small, and the number of oxides was small, and thus the hydrogen occlusion ability was reduced to generate 50 or more fish scales in the material.

Meanwhile, in the case of comparative steel 4, the fish scale defects were generated, and it is judged that this phenomenon is caused because since the contents of copper (Cu) and sulfur (S) are high, sulfides are formed while being attached to the complex oxide, and thus oxides are broken after rolling to hinder the micro-voids from being formed or fill the formed micro-voids to slightly reduce the hydrogen occlusion ability.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A steel sheet for enamel having no surface defects, comprising:

more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities, where the steel sheet includes Cr—Mn complex oxides.

2. The steel sheet for enamel having no surface defects of claim 1, wherein:

an atomic ratio of Cr/Mn in the Cr—Mn complex oxides is in the range of 0.01 to 2.

3. The steel sheet for enamel having no surface defects of claim 2, wherein:

a size of the Cr—Mn complex oxides is 1 to 25 μm.

4. The steel sheet for enamel having no surface defects of claim 3, wherein:

the number of the Cr—Mn complex oxides is $1.5\times10^2$ or more per 1 $mm^2$ of an observation view.

5. A method of manufacturing a steel sheet for enamel having no surface defects, comprising:

manufacturing a slab formed of more than 0 wt % and 0.005 wt % or less of C, 0.1 to 0.5 wt % of Mn, more than 0 wt % and 0.03 wt % or less of Si, 0.05 to 0.3 wt % of Cr, more than 0 wt % and 0.03 wt % or less of Al, 0.03 to 0.1 wt % of O, more than 0 wt % and 0.03 wt % or less of P, more than 0 wt % and 0.02 wt % or less of S, more than 0 wt % and 0.015 wt % or less of Cu, more than 0 wt % and 0.005 wt % or less of N, Fe in a remaining content, and other inevitable impurities;

manufacturing a hot rolled steel sheet by hot rolling after the slab is re-heated to 1,200° C. or more; and winding the hot rolled steel sheet at 550° C. or more, wherein, after winding, the hot rolled steel sheet includes Cr—Mn complex oxides.

6. The method of manufacturing a steel sheet for enamel having no surface defects of claim 5, further comprising:

performing cold rolling at a reduction ratio of 50 to 90% after the winding.

7. The method of manufacturing a steel sheet for enamel having no surface defects of claim 6, further comprising:

performing continuous annealing of the cold rolled steel sheet at 700° C. or more for 20 sec or more after the cold rolling.

8. The method of manufacturing a steel sheet for enamel having no surface defects of claim 5, wherein:

an atomic ratio of Cr/Mn in the Cr—Mn complex oxides is 0.01 to 2.

9. The method of manufacturing a steel sheet for enamel having no surface defects of claim 8, wherein:

in the steel sheet for enamel manufactured by the method of manufacturing the steel sheet for enamel, a size of the Cr—Mn complex oxides is 1 to 25 μm.

10. The method of manufacturing a steel sheet for enamel having no surface defects of claim 9, wherein:

in the steel sheet for enamel manufactured by the method of manufacturing the steel sheet for enamel, the number of the Cr—Mn complex oxides is $1.5\times10^2$ or more per 1 $mm^2$ of an observation view.

11. The method of manufacturing a steel sheet for enamel having no surface defects of claim 10, wherein:

in the steel sheet for enamel manufactured by the method of manufacturing the steel sheet for enamel, micro-voids are formed in the Cr—Mn complex oxide itself or a periphery thereof.

12. The method of manufacturing a steel sheet for enamel having no surface defects of claim 6, wherein:

an atomic ratio of Cr/Mn in the Cr—Mn complex oxides is 0.01 to 2.

13. The method of manufacturing a steel sheet for enamel having no surface defects of claim 7, wherein:

an atomic ratio of Cr/Mn in the Cr—Mn complex oxides is 0.01 to 2.

* * * * *